US011897023B2

(12) United States Patent
Kahl

(10) Patent No.: US 11,897,023 B2
(45) Date of Patent: Feb. 13, 2024

(54) DEVICE FOR PRODUCING A METAL MESH REINFORCEMENT

(71) Applicant: MBK Maschinenbau GmbH, Kisslegg (DE)

(72) Inventor: Manfred Kahl, Isny (DE)

(73) Assignee: MBK Maschinenbau GmbH, Kisslegg (DE)

( * ) Notice: Subject to any disclaimer, the term of this patent is extended or adjusted under 35 U.S.C. 154(b) by 0 days.

(21) Appl. No.: 18/058,936

(22) Filed: Nov. 28, 2022

(65) Prior Publication Data

US 2023/0090470 A1 Mar. 23, 2023

Related U.S. Application Data

(63) Continuation of application No. PCT/EP2021/063361, filed on May 19, 2021.

(30) Foreign Application Priority Data

Jul. 2, 2020 (DE) ..... 10 2020 117 466.7

(51) Int. Cl.
*B21F 27/10* (2006.01)
*B21F 27/12* (2006.01)

(52) U.S. Cl.
CPC ..... *B21F 27/10* (2013.01); *B21F 27/124* (2013.01)

(58) Field of Classification Search
CPC ..... B21F 27/08; B21F 27/10; B21F 27/12; B21F 27/121; B21F 27/122; B21F 27/124; B21F 11/00
See application file for complete search history.

(56) References Cited

U.S. PATENT DOCUMENTS 5,053,597 A 10/1991 Ritter et al.
5,271,436 A 12/1993 Pfender et al.
(Continued)

FOREIGN PATENT DOCUMENTS

AT 508 093 B1 12/2011
DE 10048104 A1 * 10/2001 ..... B21F 27/00
(Continued)

OTHER PUBLICATIONS

DE 102018112925 A1, Lehmann Dec. 2019.*
(Continued)

*Primary Examiner* — Edward T Tolan
(74) *Attorney, Agent, or Firm* — BURR PATENT LAW, PLLC

(57) ABSTRACT

A device for producing a metal mesh reinforcement that includes joining a plurality of long profiles and a winding profile. The device includes a welding unit for welding a longitudinal profile to a winding profile and a feed unit for feeding a portion of the winding profile provided from a master to the welding unit. The feed unit includes a cutting arrangement for cutting a profile portion of the winding profile from the master. The cutting arrangement is arranged within a cutting zone of the device remote from the welding unit such that, after cutting of the winding profile, the end portion of the winding profile cut from the master is fed from the cutting zone to the welding unit and at least one further weld is made between the cut-off end portion of the winding profile and a longitudinal profile to produce the metal mesh reinforcement.

20 Claims, 10 Drawing Sheets

(56) References Cited

U.S. PATENT DOCUMENTS

| | | | | |
|---|---|---|---|---|
| 5,665,254 | A | 9/1997 | Isono et al. | |
| 2008/0257445 | A1* | 10/2008 | Subacchi | B21F 27/124<br>140/113 |
| 2019/0118243 | A1* | 4/2019 | Pfender | B21F 27/121 |

FOREIGN PATENT DOCUMENTS

| | | | |
|---|---|---|---|
| EP | 0 561 007 | A1 | 9/1993 |
| SU | 639 635 | A1 | 12/1978 |
| WO | 89/11358 | A1 | 11/1989 |
| WO | 2008/131346 | A2 | 10/2008 |
| WO | 2018/202532 | A1 | 11/2018 |
| WO | 10 2018 112 925 | A1 | 12/2019 |
| WO | 2019/228845 | A1 | 12/2019 |

OTHER PUBLICATIONS

EP 2196271 A1, Galanos Jun. 2010.*
KR 2020014390 A, Jin Feb. 2020.*
WO 2009013774 A1, Ferrari Jan. 2009.*
WO 0139908 A1, Neckoula Jun. 2001.*
CN 108515130 A, Liu Sep. 2018.*
KR 20110050288 A, Lee et al. May 2011.*
CN 106826052 A, Ni et al. Jun. 2017.*
International Preliminary Report on Patentability (Chapter II) (Application No. PCT/EP2021/063361) (with Ch. II Claims) dated Jun. 3, 2022 (with English translation).
German Search Report (Application No. 10 2020 117 466.7) dated Mar. 9, 2021.
International Search Report and Written Opinion (Application No. PCT/EP2021/063361) dated Aug. 2, 2021.

* cited by examiner

DEVICE FOR PRODUCING A METAL MESH REINFORCEMENT

CROSS REFERENCE TO RELATED APPLICATIONS

This application is a continuation of International Application No. PCT/EP2021/063361 filed May 19, 2021, which designated the United States, and claims the benefit under 35 USC § 119(a)-(d) of German Application No. 10 2020 117 466.7 filed Jul. 2, 2020, the entireties of which are incorporated herein by reference.

FIELD OF THE INVENTION

The present invention relates to a device for producing a metal mesh reinforcement.

BACKGROUND OF THE INVENTION

In mechanical engineering, machines for producing metal mesh reinforcements from metal profiles or steel profiles with multiple longitudinal profiles and with one winding profile are known.

Machines of this type have a welding unit for welding a longitudinal profile to a winding profile at a connecting point of the two metal profiles. In addition, the machine comprises a feed unit for feeding a portion of the winding profile, which is provided from a master, also referred to as coil, to the welding unit. The machine has a cutting arrangement for severing the winding profile in order to separate a profile portion of the winding profile from the master.

These machines serve to produce metal mesh reinforcements, for example, for steel-reinforced concrete elements such as concrete pipes or supports of steel-reinforced concrete.

A machine makes it possible to manufacture various reinforcements for different pipes or supports with different outer diameters. In this respect, setting and equipping the machine to suit a respectively desired metal mesh reinforcement to be produced or interchanging the longitudinal and/or winding profiles to be processed is associated with a relevant expenditure on time and personnel. In particular, the welding unit of the machine must be set to a respective reinforcement outer dimension. Furthermore, it is usually the case that different winding profile diameters are processed, this entailing corresponding interruptions to the actual production process.

With regard to an economic use of such machines, what is desired, in particular, is a high degree of automation and minimized deployment of personnel, combined with process interruptions that are short as possible and a low susceptibility to faults of the machine operation.

SUMMARY OF THE INVENTION

It is an object of the present invention to improve the known machines for producing metal mesh reinforcements from metal profiles from an economic and technical perspective, in particular, with regard to the selection and variable processing of different winding profiles.

The starting point of the present invention is a device for producing a metal mesh reinforcement from interconnected metal profiles, wherein the metal mesh reinforcement has multiple longitudinal profiles and one winding profile, wherein the device comprises a welding unit for welding a longitudinal profile to the winding profile at a connecting point of the two metal profiles and a feed unit for feeding a portion of the winding profile, provided from a master, to the welding unit, wherein the feed unit comprises a cutting arrangement for severing the winding profile in order to separate a profile portion of the winding profile from the master.

The metal mesh reinforcement geometry is formed by the arrangement of the longitudinal profiles, which are arranged e.g. on a rotatable main wheel. The geometry of the metal mesh reinforcement is preferably cylindrical with e.g. a round, oval or square base area. In order that the longitudinal profiles remain arranged in the geometry, the longitudinal profiles are connected to a winding profile, the one winding profile being connected to the longitudinal profiles, in particular, from the start of the longitudinal extent of the longitudinal profiles, in particular, to the end of the longitudinal extent of the longitudinal profiles, that is to say is connected to each longitudinal profile multiple times.

In order to produce the metal mesh reinforcement more easily, the longitudinal profiles are rotated on the rotatable main wheel and in the process the winding profile is wound around the longitudinal profiles. A longitudinal profile is connected to the winding profile non-detachably; by continuing to rotate the main wheel the winding profile passes to the next longitudinal profile and is connected to this longitudinal profile, etc. the profiles are welded together at the connecting point or weld point by a welding unit.

The metal mesh reinforcement, which may be e.g. in the form of a reinforcement body or a reinforcement cage, is advantageously designed as a reinforcement for a pipe, a pile, a support and/or a pillar. The metal mesh reinforcements are preferably used for shaft and concrete pipe reinforcements in structural and/or civil engineering. The reinforcement body has, for example, a cross portion, in particular, when viewed transversely to a longitudinal extent of a rod, which is rectangular, square, polygonal, round and/or oval in shape.

In particular in civil engineering, a pressure acts on the longitudinal extent of the buried installed reinforcement, e.g. a metal mesh reinforcement. In this respect, the reinforcement is e.g. a part of the steel-reinforced concrete pipe. On account of e.g. the different pressures exerted on the metal mesh reinforcement along its longitudinal extent, winding profiles with different stabilities are used, for example, and thus different outer dimensions of the winding profiles are required for different metal mesh reinforcements. The outer dimension preferably corresponds to the maximum cross-sectional extent of the winding profile. For example, given a circular cross portion of the winding profile, the outer dimension is the diameter of the circle. The outer dimensions of the respective winding profiles can vary between 4 and 10 mm and more, for example. The winding profiles are for example winding wires, which preferably consist of a comparatively readily weldable metal.

The essence of the present invention is that the cutting arrangement is also present in a cutting region of the device that is remote from the welding unit, that the device is configured, after the winding profile has been severed, to feed the end portion of the winding profile that was separated from the master from the cutting region to the welding unit and at least one further weld is made between the separated end portion of the winding profile and a longitudinal profile to complete the metal mesh reinforcement.

Up to now, the winding profiles for each metal mesh reinforcement were manually interchanged before the welding of the longitudinal profiles to a winding profile. The present invention makes it possible to interchange the winding profile in an automated manner. This is advantageous because it is possible in a comparatively time-saving manner and with a reduced expenditure on personnel.

In this respect, automated interchanging of the winding profile is only possible in that in the device there are multiple winding profiles, which are fed from a master, e.g. a coil, of the device. Advantageously, the winding profiles in the device have different outer dimensions. Since, on the one hand, the masters are bulky and, on the other hand, multiple masters are present, the masters are several meters away from the welding unit.

Since the masters of the winding profiles are remote from the welding unit, it is necessary to feed the selected winding profile in an automated manner and safely to the welding unit. In the process, the winding profile is fed by the feed unit of the welding unit.

After the winding profile has been fed to the weld point by the feed unit, the winding profile is connected to the longitudinal profiles at the welding unit. In particular when there are still only a few weld points left to complete the metal mesh reinforcement, it then being the case that already multiple weld points exist between the winding profile and longitudinal profiles, it is possible for the winding profile to be severed at a point close to the master by means of the cutting arrangement. The one end of the winding profile, which is separated from the end wound up on the master, is part of the winding profile for the production of the metal mesh reinforcement. This end and the longitudinal portion of the winding profile separated from the master, which longitudinal portion extends from the separating point to the final weld point on one longitudinal profile, can then be drawn toward the welding unit and wound around the longitudinal profile at the longitudinal profile in question in order to produce the final weld point.

According to the present invention, the cutting arrangement is present in a cutting region remote from the welding unit, the distance between the cutting region and the welding unit preferably being in the range from 5500 mm to 5700 mm. The distance between the cutting region and the welding unit is between 3000-5500 mm or between 5700-7000 mm, for example. This comparatively great distance must be traversed by the winding profile. For this purpose, the winding profile is moved to the weld point by means of a drive until a first weld point exists between the winding profile and the longitudinal profile, after which the winding profile is drawn by rotating the main wheel.

During the separation of the winding profile, e.g. the continuous production of the metal mesh reinforcement is not interrupted, that is to say that the winding profile continues to be fed to the welding unit and at the welding unit the winding profile is non-detachably connected to the longitudinal profiles. Advantageously, the speed of the rotatable main wheel and thus the speed at which the winding profile is drawn can be slowed down for the separation of the winding profile.

Since the metal mesh reinforcement is not yet complete when the winding profile is being separated, the end portion of the winding profile produced by separating the winding profile is fed to the welding unit. The winding profile also continues to be welded to the longitudinal profiles at the welding unit, until the end portion of the winding profile is welded to a longitudinal profile at a final weld point. The metal mesh reinforcement is then complete.

It is likewise advantageous when the end portion of the winding profile is at most 5 cm away from the very last weld point between the winding profile and a longitudinal profile.

In principle, an in particular computer-assisted control unit of the device and/or of the machine is present to manage the operation of the device and/or the machine, respectively. Apart from general operational control and management, the control unit also preferably determines the separating point of the winding profile.

Advantageously, a synchronization unit is present, which is designed in such a way that the feed unit and the welding unit can be moved at the same time and together in a common direction coupled to one another, if the welding unit can be adapted in a driven manner to a desired outer dimension of the metal mesh reinforcement, in order to predefine a working position of the welding unit in which the welding unit remains for the production of a metal mesh reinforcement with a constant outer dimension. In this respect, advantageously time is saved and the expenditure on work is reduced, since the synchronization unit makes it possible to adapt the working position of the welding unit in an automated manner.

Advantageously, the movement of the welding unit is synchronous with the movement of the feed unit, the two units being movable in an identical direction, preferably in a perpendicular direction in relation to the axis of rotation of the main wheel.

It is of advantage that the distance between the cutting arrangement, which is part of the feed unit, and the welding unit is constant during the mutually coupled movement of the welding unit and the feed unit. The welding unit is moved by means of a drive and this movement is transmitted e.g. to a first transmission unit, which is coupled, in particular, mechanically coupled, to a second transmission unit. The second transmission unit then preferably transmits the movement to the feed unit. The two coupled transmission units are e.g. part of the synchronization unit.

The outer dimension of the metal mesh reinforcement that can be produced by the machine may advantageously differ by e.g. up to 1600 mm, e.g. an outer diameter with respect to the axis of rotation. In this case it is advantageous if the welding unit can be moved back and forth by 800 mm in a perpendicular direction in relation to the axis of rotation of the main wheel, in order to set the working position of the welding unit. If appropriate, it is sufficient for the welding unit to be movable by 700 mm, 600 mm, 500 mm, 400 mm, or 300 mm.

It is likewise of advantage for the welding unit to be linearly movable. The welding unit can preferably be moved reversibly back and forth and in a driven manner, for example, by means of an electric and/or by means of a hydraulic and/or a pneumatic drive.

The control unit preferably sets the working position of the welding unit in an automated manner. The control unit preferably controls the drive of the welding unit, preferably in interaction with sensor means of the device, such as e.g. travel and/or position sensors, for this purpose.

The working position of the welding unit is the position into which the welding unit can be transferred in a driven manner in order to weld a longitudinal profile to the winding profile for a desired outer dimension of the metal mesh reinforcement. In the process, the welding unit is moved in a driven manner in a perpendicular direction in relation to the axis of rotation of the main wheel, until the welding unit is adapted to the associated outer dimension of the respective metal mesh reinforcement. In this respect, the welding unit does not make direct contact e.g. with a longitudinal profile, because it is still necessary for there to be enough space for the winding profile between the outer side of the longitudinal profile and a welding electrode of the welding unit. After the working position of the welding unit is set for the purpose of welding a winding profile to a longitudinal profile, this position is no longer changed for the production of the metal mesh reinforcement. This relates to metal mesh reinforcements which have a uniform outer dimension.

It is of advantage that the winding profile has at least two winding profile portions, wherein the first winding profile portion has a constant first outer dimension and the second winding profile portion has a constant second outer dimension different to the first outer dimension, wherein the device is designed in such a way that the winding profile portions with different outer dimensions can be interchanged in an automated manner during the production of the metal mesh reinforcement.

For the production of the metal mesh reinforcement, it is also conceivable to use more than two winding profile portions for a single metal mesh reinforcement, it preferably being the case that the multiple winding profile portions have different outer dimensions. It is furthermore also possible to change over between two winding profile portions with different outer dimensions multiple times, for example.

It is preferably the case that the first winding profile portion for the metal mesh reinforcement originates from a first winding profile of a first master, and the second winding profile portion for the metal mesh reinforcement originates from a second winding profile of a second master. The winding profiles or the winding profile portions preferably have constant different outer dimensions. Advantageously, a starting portion of the first winding profile portion is welded to a longitudinal profile and multiple points at which the first winding profile portion is welded to multiple longitudinal profiles follow, until the end portion, separated by the cutting arrangement, of the first winding profile portion is welded to a longitudinal profile. Advantageously, in the feed unit directly behind the end portion of the first winding profile portion, there follows a starting portion of the second winding profile portion, with the result that the starting portion of the second winding profile portion can be welded either to the longitudinal profile to which the end portion of the first winding profile was welded or to the next longitudinal profile. It is also the case that the second winding profile portion is welded to multiple longitudinal profiles until an end portion, separated by the cutting arrangement, of the second winding profile is welded to a longitudinal profile. In this respect, by welding the end portion of the second winding profile to a longitudinal profile, the metal mesh reinforcement can be completed, or welding of a third winding profile portion to longitudinal profiles follows. In this respect, the outer dimension of the third winding profile portion may correspond to the outer dimension of the first winding profile portion or the third winding profile portion has an outer dimension which is different than the outer dimension of the first and second winding profile portions.

The control unit makes it possible to interchange the winding profile or the winding profile portion in an automated manner; the control unit preferably can be programmed for this purpose. The programmed control unit is designed to interchange the winding profile or winding profile portion.

It is advantageous for the welding unit to be present in such a way that the welding unit can be adjusted in a direction transverse to the longitudinal extent of the longitudinal profile to adapt to the working position. The welding unit remains in the working position for the production of a metal mesh reinforcement with a constant outer dimension.

A main wheel, which is mounted rotatably about an axis of rotation, is preferably present on the machine, wherein the main wheel is designed for the arrangement of multiple longitudinal profiles which can be received next to one another around the axis of rotation.

Advantageously, the main wheel has spoke-like portions on which the multiple longitudinal profiles are arranged. The outer dimension of the metal mesh reinforcement preferably can be adapted in that supports for all longitudinal profiles can be moved along the spoke-like portions in a radial direction in relation to the axis of rotation of the main wheel.

Advantageously, both the welding unit and the feed unit can be moved in a perpendicular direction in relation to the axis of rotation of the main wheel. The feed unit can be moved along linear guide elements, e.g. parallel rails, for example. The guide elements are advantageously arranged on a floor. The guide elements preferably extend in the perpendicular direction in relation to the axis of rotation of the main wheel.

It is furthermore advantageous if the synchronization unit comprises transmission units, by way of which the feed unit and the welding unit are coupled to one another in such a way that the feed unit and the welding unit can be moved at the same time.

The transmission unit preferably comprises e.g. hydraulic and/or pneumatic and/or electric mechanisms. For example, the transmission units comprise preferably precisely two transmission units, e.g. hydraulic cylinders. The movement of the feed unit and welding unit is preferably synchronized. It is advantageous if the movement of the welding unit is converted directly into a movement of the feed unit, with the result that the distance between the welding unit and the feed unit is constant.

It can be considered an advantage if the device comprises a receptacle, in which multiple separate and different winding profiles can be supplied in such a way that selectively precisely one of the multiple winding profiles supplied in the receptacle can be fed to the cutting arrangement.

Advantageously, the different, separate winding profiles can each be unrolled from the respective master, e.g. a winding body or a coil, and a front free end portion of the winding profile can be guided into the receptacle. After being placed in the receptacle, the winding profile is preferably no longer removed from or moved out of the receptacle, e.g. in the direction of the master.

The receptacle preferably comprises supporting portions, e.g. channels or tubes, precisely one respective supporting portion for precisely one winding profile. Advantageously, multiple winding profiles, in particular 3-7, preferably e.g. 5 winding profiles, each with different outer dimensions with respect to the other winding profiles, are present in the receptacle. Two or more or all winding profiles may also each have the same outer dimension. From among the multiple winding profiles, preferably precisely one single winding profile can be selected or used for the production of a metal mesh reinforcement.

It is advantageous if the feed unit comprises an advancing arrangement with a drive unit for the driven movement of the winding profile in a longitudinal direction of the winding profile, wherein the advancing arrangement is designed to move, from among multiple winding profiles provided next to one another in the feed unit, precisely one of the multiple provided winding profiles to the welding unit in a driven manner by means of the drive unit.

Advantageously, precisely one winding profile of the multiple winding profiles present in the receptacle is selected and this selected winding profile is moved to the welding unit in a driven manner. The other winding profiles of the multiple provided winding profiles are not subject to any driving action by the drive unit. In this way, the other winding profiles are thus unmoved with respect to a movement in a longitudinal direction of the winding profile.

Advantageously, the advancing arrangement is designed to subject precisely one winding profile to a force or driving action, in particular, a compressive force and/or a drive torque, in such a way that the selected winding profile is moved to the welding unit with an advancing or a pushing movement of the feed unit.

It is also of advantage if the advancing arrangement can be moved transversely to the longitudinal extent of the winding profile, in order to conduct e.g. a single selectable winding profile to the cutting arrangement.

Advantageously, only one receiving point is present on the cutting arrangement for the winding profile. After the advancing arrangement, the winding profile preferably enters the receiving point of the cutting arrangement. For this purpose, the advancing arrangement can be moved transversely to the longitudinal extent of the winding profile. For example, the advancing arrangement can be moved by a drive, e.g. by an electric and/or pneumatic and/or hydraulic unit.

It is of advantage for the provided winding profiles to be interchangeable in an automated manner in the advancing arrangement.

Advantageously, a first winding profile on the advancing unit can be selected and moved to the cutting arrangement by the drive unit, the first winding profile being conveyed from the cutting arrangement to the welding unit. The welding unit preferably welds the starting portion of the first winding profile portion of the first winding profile to a longitudinal profile, at the cutting arrangement the first winding profile being severed and the separated end portion of the first winding profile portion being welded to a longitudinal profile. Advantageously, after severing the first winding profile portion of the first winding profile at the cutting arrangement, a second winding profile on the advancing arrangement can be selected in that the second winding profile is moved to the cutting arrangement by the drive unit. The first and second winding profiles preferably have different outer dimensions.

An operator can preferably input the outer dimensions and the lengths of the winding profile portions for a metal mesh reinforcement into the control unit. Advantageously, the control unit communicates with the advancing arrangement, with the result that the winding profiles on the advancing arrangement are interchanged by means of the drive unit in an automated manner. The control unit also preferably communicates with the cutting arrangement, with the result that the lengths of the individual winding profile portions for the metal mesh reinforcement match or the cutting device severs the winding profiles at the correct point.

It is also advantageous for the advancing arrangement to have two oppositely situated drive elements comprising an advancing element and a counter element, wherein the drive elements make it possible to apply a driving action to precisely the one of the multiple provided winding profiles. In this way, the selected winding profile can be pushed as far as the welding unit by the advancing arrangement.

Advantageously, at least one separate counter element is assigned to each individual one of the multiple winding profiles provided in the advancing arrangement. The winding profile is gently clamped in between the counter element and the advancing element for the advancement. The counter element is preferably pressed onto the selected winding profile. The winding profile is pressed onto the advancing element under the pressing action of the counter element. The advancing element can be moved, and, therefore, the result of the movement of the advancing element is that the winding profile is moved in a longitudinal direction of the winding profile in a driven manner under the effect of friction between the advancing element and the winding profile. By pressing the winding profile onto the advancing elements via the respective counter element and moving the advancing elements, the selected winding profile is subject to a driving action and thus a pushing movement. The winding profile that is pushed in a driven manner is transported by the advancing arrangement e.g. to the welding unit. The advancing element may be pushed e.g. via a suitable mechanism or drive in a driven manner. A continuous advancing element may be situated opposite the counter elements. However, it is also possible for pairs of counter elements and advancing elements to be present. In the case of multiple advancing elements, they are preferably coupled and driven together.

An advancing element of the advancing arrangement is preferably in frictional contact with the winding profile, it being possible for the frictional contact to be made on one side or multiple sides or both sides on the outside of the winding profile. The force, in particular, compressive force and/or the drive torque, that acts on the winding profile comprises at least one force vector in a longitudinal direction of the winding profile.

The compressive force that acts on the winding profile is preferably exerted on the winding profile only until at least one weld point is produced between the pushed winding profile and a longitudinal profile by means of the welding unit. After this, the selected winding profile is advantageously drawn in a drawing movement through the longitudinal profiles rotating on the main wheel. In the process, the winding profile is wound around the outside of the longitudinal profiles and therefore further lengths of the winding profile are unwound from the associated master in a drawing motion.

After one or some weld points between the winding profile and multiple longitudinal profiles, pressure is no longer exerted on the winding profile by the counter element.

It has also emerged as advantageous for preferably precisely one drive unit to be provided such that an advancing element or multiple advancing elements is or are driven at the same time in the driving state by the drive unit.

It is preferably the case that 2 advancing elements are provided, which can be driven rotationally by the drive unit. The drive unit preferably comprises a drive shaft and/or a drive roller, a drive and a connecting element. The advancing elements are advantageously connected by means of a connecting element, e.g. a belt, to the drive roller, which is connected to the drive via a drive shaft. An individual advancing element can also be driven in this way. The drive may be electric, for example, provided with e.g. an electric motor. The direction of rotation of the drive and therefore the direction of rotation of the advancing rollers is preferably switchable, for example, from an anticlockwise movement to a clockwise movement or from a clockwise movement to an anticlockwise movement. The winding profile can preferably be moved to the welding unit by the advancing arrangement in the case of a clockwise movement. It is likewise of advantage when the counter elements and the advancing elements push the selected winding profile to the welding unit through deflection elements.

The advancing elements are preferably advancing rollers, which, in particular, have a fluted frictional area and/or a rough surface, which can be brought into contact with the winding profile. The advancing elements are preferably mounted rotatably and preferably have a convex contact area for the winding profile.

It can be considered an advantage when the counter element can be transferred from a first switching state into a second switching state by a switching device, wherein the counter element presses the selected winding profile against the advancing element in the second switching state.

In the first switching state, the counter element preferably has no contact with the winding profile, and the counter element is therefore preferably spaced apart from the winding profile in question. In this way, in the first switching state the winding profile has no pressure contact with the advancing element and therefore no driving action. The switching device preferably brings the counter element into contact with the winding profile, with the result that the counter element presses onto the winding profile, which is pressed onto the advancing element. In the process, the winding profile is preferably supported on the advancing element. In this way, the winding profile undergoes a driven movement in the second switching state.

In a preferred configuration of the present invention, for each winding profile there are multiple counter elements, preferably precisely 2 counter elements. The respective associated counter elements preferably can be switched in a driven manner from the first switching state to the second switching state and back again. The associated counter elements can be switched from the first to the second switching state e.g. pneumatically and/or hydraulically and/or electrically, it being the case that in the second switching state the counter elements can be pressed against the winding profile. When there is more than one counter element for one winding profile, the counter elements that can be pressed onto the one assigned single winding profile are advantageously connected to one another. The associated two or more counter elements are advantageously connected by means of a rigid element, which e.g. consists of metal and/or plastic. The rigid element which connects the associated counter elements to one another preferably has a cross-like form, with e.g. one plate of the cross-like rigid element connecting the two counter elements and a further plate of the cross-like rigid element advantageously protruding beyond the counter elements.

The counter elements are preferably rollers, which are preferably mounted rotatably.

The advancing arrangement advantageously comprises a profile retaining system and/or a profile brake, which are present for a winding profile, wherein the profile retaining system is designed to retain those winding profiles that from among all of the supplied winding profiles are not selected for processing, wherein just one single winding profile can be selected for the further processing.

Likewise advantageously, the profile retaining systems retain the winding profiles that were not selected for the production of a metal mesh reinforcement in the feed unit, with the result that the winding profiles are stored for the next metal mesh reinforcement, if appropriate. For the production of a metal mesh reinforcement, generally only a single winding profile with an associated constant outer dimension is required.

Advantageously, the profile brake is designed in such a way that the drawing or pushing speed of the selected winding profile can be slowed down, e.g. to separate the winding profile in the cutting region.

Advantageously, the cutting arrangement is designed such that the winding profile can be severed while the winding profile is moved at the same time in its longitudinal direction to the welding unit.

The cutting arrangement preferably comprises a cutting apparatus with e.g. two cutters. Advantageously, the cutting apparatus can be moved up to 350 mm in a longitudinal direction of the winding profile, the cutting apparatus conjointly moving temporarily with the winding profile. The cutting apparatus is shears, for example, preferably floating shears. Floating shears are understood to mean shears that can be moved during the cutting operation.

Advantageously, the rotational speed of the main wheel or of the metal mesh reinforcement about the axis of rotation, and, therefore, the drawing speed of the winding profile, can be slowed down for severing the winding profile by means of the cutting apparatus. Advantageously, the continuous production of the metal mesh reinforcement is not interrupted for the severing of the winding profile and the welding of the winding profile to the longitudinal profiles by means of the welding unit at the main wheel can continue.

It is furthermore advantageous when the cutting arrangement comprises a measuring element, which communicates with the control unit. The measuring element preferably measures the length of the winding profile that has passed through in order to determine the cutting point on the winding profile, for example. The measurement at the measuring element preferably begins with the end portion of the winding profile, which comes from the master for the production of a metal mesh reinforcement. It is consequently possible, with a continuous measurement of the winding profile that has passed through, to determine when the winding profile must be severed to accurately fit to the final weld point. The measuring element is preferably located between the advancing arrangement and in front of the cutting apparatus in the pushing direction.

It is also advantageous when the feed unit comprises a guide mechanism, which is designed to guide the driven winding profile from the cutting arrangement to the welding unit, wherein the guide acts contiguously on the winding profile at least in certain portions, so as to define the spatial travel of the winding profile moving in a driven manner.

The guide mechanism preferably comprises at least one straight connecting element and a curved deflecting element, preferably a deflecting curve. The deflecting element is designed to change the direction of the winding profile, e.g. through a curved shape. The deflecting element preferably comprises a multiplicity of rollers located on a retaining part of the deflecting element. The retaining parts of the deflecting element may be in a floor area or be aligned at an angle thereto, for example. The rollers are preferably respectively present in pairs and/or in threes, with the result that a pair of rollers or a set of three rollers is situated opposite a pair of rollers or a set of three rollers. The pair of rollers or set of three rollers preferably forms a type of annular groove between the rollers in which the winding profile is guided. The rollers may have the same or different shapes. It is furthermore also possible for a single roller to form an annular groove by providing an indentation in a single roller. The rollers, e.g. pairs of rollers or a set of three rollers, are preferably arranged one behind another in the pushing direction of the winding profile that is moved in a driven manner and so as to be facing transversely thereto. The rollers are all mounted rotatably, for example. Advantageously, the rollers are arranged in such a way that the winding profile can be pushed through the deflecting elements in a predefined region with a factor of e.g. 1 to 2 with respect to the outer dimension, some or all of the rollers being in contact with the winding profile, and it being possible for the rollers to be in contact with the winding profile on a respective side of the deflecting curves or else on both sides of the deflecting curves when the winding profile extends over the entire length of the deflecting elements.

A deflecting element is preferably aligned in a horizontal plane or a plane at an angle thereto. Multiple deflecting elements are preferentially present, preferably 2 deflecting elements, the deflecting elements being arranged between the cutting arrangement and the welding unit. The first deflecting element, which preferably follows the cutting arrangement in the pushing direction of the winding profile, preferably deflects the winding profile from a direction along the longitudinal extent of the longitudinal profiles to a direction transverse to the longitudinal extent of the longitudinal profiles. Advantageously, a second deflecting element, which is arranged in front of the welding arrangement in the pushing direction of the winding profile, defects the winding profile from a direction transverse to the longitudinal extent of the longitudinal profiles to a direction along the longitudinal extent of the longitudinal profiles. For example, the deflecting elements are connected to one another by way of a connecting element, e.g. a tube, in which the winding profile is preferably guided from one deflecting element to the next deflecting element.

The welding unit advantageously comprises a winding profile guide and a welding arrangement, wherein the winding profile guide is designed to conduct the winding profile to the welding arrangement.

The winding profile guide preferably centers the winding profile on the weld point, in particular, before the first weld has been made between the winding profile and a longitudinal profile.

The winding profile guide is preferably between the final deflecting element and the welding arrangement.

A further advantage in merges when the winding profile guide has a contact side and a positioning side, wherein the contact side and the positioning side can be moved relative to one another, and wherein the contact side and the positioning side are matched to one another in such a way that a winding profile guided up between the contact side and the positioning side is forced into a centered position when the positioning side and the contact side are moved toward one another.

Advantageously, the positioning side can be moved toward the contact side in that the positioning side is pivotable about a pivot pin, for example. Advantageously, the contact side can be moved tangentially in relation to the main wheel, so that the winding profile can be positioned precisely on the weld point. The winding profile can deviate from the desired weld point even in the case of small distances between the contact side and the weld point. In particular, winding profiles with a small outer dimension are increasingly flexible and should preferably be guided correspondingly.

It is preferably the case that the two sides of the winding profile guide are in contact with the winding profile when the two sides are moved relatively toward one another, e.g. into a closed position. The two sides of the winding profile guide are preferably in a closed position provided that the weld has not been made between the winding profile and a longitudinal profile.

Advantageously, after one weld point has been established or after a few weld points at which a winding profile is connected to longitudinal profiles, the positioning side can be moved away from the contact side, e.g. into an open position. Advantageously, the winding profile rests on the contact side in the open position.

It is also advantageous when the winding profile guide is pivotable, with the result that the winding profile guide rests e.g. tangentially on the metal mesh reinforcement to be produced or on the body which is formed from the longitudinal profiles.

It is advantageous for the positioning side to have a depression matched to the winding profile.

Advantageously, a respective winding profile guided up to the winding profile guide is first of all brought into a position between the positioning side and the contact side, which position deviates or can deviate from the ideal or centered position of the winding profile for the welding operation. When a new winding profile is guided up for the first time, the positioning side and the contact side are moved away from one another and leave enough intermediate space for the winding profile coming from the master on a run-in side of the winding profile guide to have sufficient room to be threaded in between the positioning side and the contact side.

A portion of the winding profile is then positioned between the positioning side and the contact side. The positioning side and the contact side then move relative to one another and toward one another. The winding profile is exactly positioned and centered based on the weld point on account of the relative movement of the positioning side and the contact side.

The winding profile centered with the aid of the depression leaves the winding profile guide preferably precisely positioned on a run-out side in such a way that the winding profile reaches the weld point spatially precisely, that is to say precisely reaches it in terms of direction and position. The depression is e.g. wedge-like, for example, in the form of a prism. The weld point preferably is in line with and continues in a straight line the central longitudinal axis of the positioning side.

Since the winding profile, for example, a winding wire with a diameter of a few millimeters, is flexible, there is the risk that the position of the winding profile deviates again from the centered position and alignment when even only over a small length no guide is present, e.g. after leaving the winding profile guide, toward the weld point on the longitudinal profile. This tendency increases as the end of the winding profile moving away from the winding profile guide gets further away. This means that the greater the distance is between the run-out side of the winding profile guide and the weld point, the greater the possible deviation of the winding profile centered in the winding profile guide is from the ideal position with respect to the weld point.

It is therefore advantageous for the winding profile guide or the run-out side of the winding profile guide, at which the centered winding profile leaves the winding profile guide, to be as close as possible, preferably in the direct vicinity, of the weld point between the winding profile and the longitudinal profile. The distance between the run-out side of the winding profile guide and the weld point is preferably minimal and is measured, for example, in millimeters, e.g. is smaller than two times the diameter of the winding profile.

Accordingly, the device is preferably equipped such that, after leaving the winding profile guide, the centered winding profile preferably reaches the weld point directly, for example, after one millimeter or after a few millimeters.

In particular, the winding profile guide is present such that the winding profile reaches the weld point, at which an electrode of the welding arrangement welds the winding profile to a longitudinal profile, in a precisely aligned and/or positionally exact way.

Advantageously, the welding arrangement has a resiliently mounted electrode, the welding arrangement being movable in a direction transverse to the longitudinal extent of the longitudinal profile. The welding arrangement is preferably finely positioned in the working position during the continuous production of the metal mesh reinforcement.

Advantageously, the welding arrangement comprises two electrodes, it preferably being the case that one electrode is a welding electrode and a second electrode is a contact electrode. The welding electrode and contact electrode are in the form of rollers, for example. The electrodes are preferably each mounted resiliently.

It is furthermore advantageous for the movement of the electrodes to be damped by the spring mounting, on the one hand, and for the electrodes to be able to be pressed against a counterpart for the fine positioning, on the other hand. The welding electrode can preferably be pressed against the winding profile, it preferentially being the case that the winding profile is pressed onto a longitudinal profile. With continuous rotation of the main wheel, the welding electrode remains, in particular, permanently and always in touching contact on the winding profile. This is preferably achieved by a spring force, which acts on the electrode in the direction of the winding profile in a manner corresponding to the resilient mounting.

Advantageously, the contact electrode presses on a contact body which preferably consists of metal, in particular, copper.

The contact electrode preferably is in contact with the contact body in cycles, since the spaced-apart contact bodies are arranged on the spoke-like portions of the main wheel and are offset in relation to the longitudinal profiles on the spoke-like portions in a radial direction in relation to the axis of rotation of the main wheel. It is preferably the case that welding can be done at the welding electrode only when the contact electrode is in contact with the contact bodies.

It is of advantage when the contact electrode and the welding electrode are spaced apart from one another both in a radial and in an axial direction in relation to the axis of rotation of the main wheel.

It is of advantage for a spring mounting to be present, which is designed to compensate the difference in the outer dimension of the winding profile and/or the wear of the welding arrangement in an automated manner.

In this way, it is possible to achieve fine positioning of the welding arrangement and of the electrode before the start of a work or welding process, the spring mounting making it possible to set a pressing force of the electrode depending on the relative stroke. The relative stroke may, for example, be a predefinable stroke of a cylinder relative to a piston. The setting can be automated by predefining a setpoint value "X", for example, in millimeters.

The cylinder/piston unit comprises, in particular, a pneumatic arrangement, more precisely a pneumatic cylinder/piston unit, e.g. a pneumatic spring. With a pneumatic cylinder and a pneumatic piston, for example, the winding profile can be set to adapt the level of a pressing action or pressing force of the electrode against the counterpart.

A sensor arrangement, for example, e.g. with a travel sensor for detecting the stroke of the cylinder relative to the piston or the retraction stroke and for providing the information to the control unit, is present for the predefinition of the setpoint value.

Advantageously, a welding electrode can be positioned in a predefinable but then fixed working position by a drive, wherein a locking mechanism is present which positionally fixedly holds the welding electrode in the working position.

It can be considered an advantage when the drive is a spindle drive, which preferably can be easily realized by an electric drive.

It is furthermore advantageous for the welding electrode to have a securing arrangement for locking a set working position of the welding electrode. A toothed rod with a toothed contour and a mating toothed contour is preferably provided for this purpose. The toothed rod is moved linearly by way of a drive, such as a spindle drive, preferably an electric drive, e.g. by means of a toothed wheel, for the purpose of setting the working position of the welding electrode. The mating toothed contour locks the position of the welding electrode by engaging in the toothed contour of the toothed rod.

The present invention similarly extends to a machine comprising a main wheel, which can be rotated in a driven manner, for receiving multiple longitudinal profiles, wherein a device as per one of the designs described above is provided.

The machine with the device is in the form of a cage welding machine, for example, which serves to produce steel and/or metal mesh reinforcements, such as, in particular, reinforcing cages for shaft or concrete pipes, piles, supports or beams of concrete.

The machine serves to produce a metal mesh reinforcement from multiple longitudinal profiles and one winding profile connected to the longitudinal profiles. The machine preferably has a feed unit for the winding profile provided from a master, preferably wound up on a coil. The machine moreover comprises, on either side of the main wheel and opposite to one another, a longitudinal profile positioning portion and a transporting portion with a rail guide for a linear movement of a retaining arrangement that rotates simultaneously with the main wheel during operation and receives the finished face-side end of the metal mesh reinforcement.

BRIEF DESCRIPTION OF THE DRAWINGS

Further features and advantages of the present invention will be described in more detail with reference to a schematically illustrated exemplary embodiment of the present invention.

DETAILED DESCRIPTION OF THE INVENTION

Figure 1:
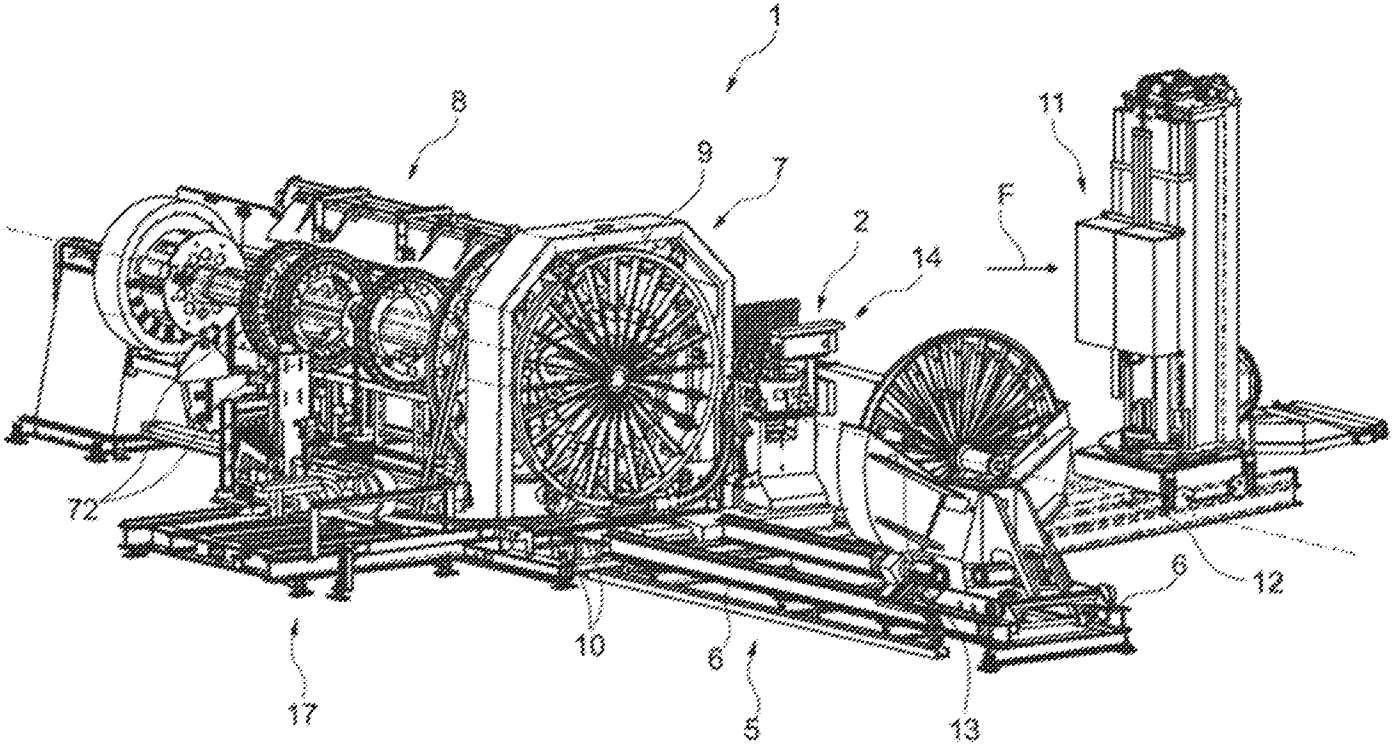
FIG. 1 shows a perspective overall view of a machine with a device according to the present invention for producing a metal mesh reinforcement.
Figure 7:
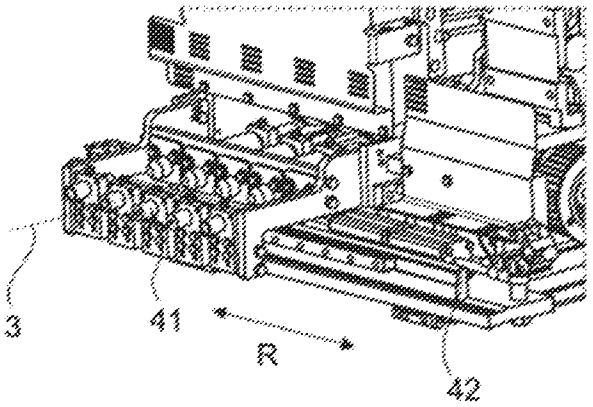
FIG. 7 shows a perspective view of part of the advancing arrangement approximately from detail B in FIG. 5.

FIG. 1 shows a perspective overall view obliquely from the front of a machine 1 according to the present invention, which comprises a device 2. The machine 1 is designed to produce a metal mesh reinforcement from multiple metal profiles, comprising longitudinal profiles 4 (see FIG. 13) and a winding profile 3 (see FIGS. 7-9).

The machine 1, such as, for example, a cage welding machine, serves to produce steel or metal mesh reinforcements, such as, in particular, reinforcing cages for shaft or concrete pipes, piles, supports or beams of concrete.

Figure 14:
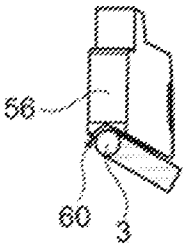
FIG. 14 shows a perspective view of a detail of the winding profile guide according to FIG. 13 with a winding profile illustrated schematically in cross portion.
Figure 13:
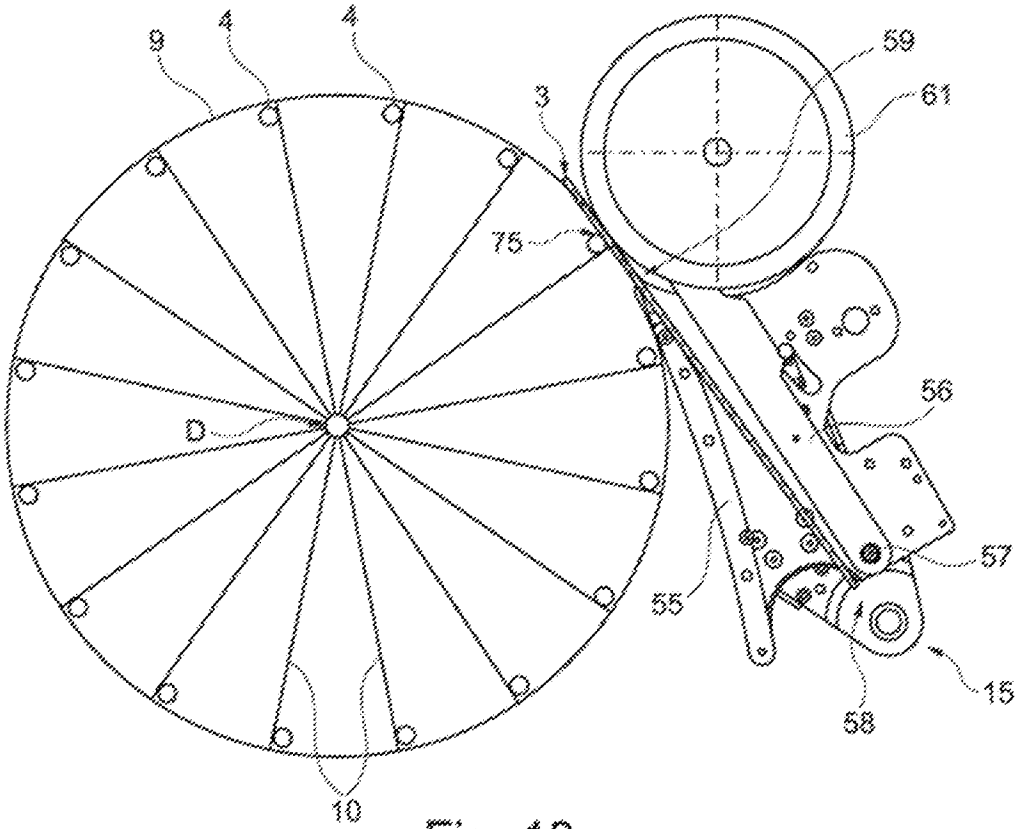
FIG. 13 shows a side view of a winding profile guide of the device according to FIG. 2 with a schematically illustrated main wheel.

The reinforcements that can be produced have a plurality, for example, 24 or 48, of parallel longitudinal profiles 4 around a central longitudinal axis of the machine 1, and a welded-on winding profile 3, such as e.g. a flexible winding wire, laid helically around the outside of the longitudinal profiles 4 (see, in particular, FIGS. 13 and 14). The winding profile 3 or the winding wire is preferably made from metal. The winding profile 3 is welded to all of the longitudinal profiles 4 at respective weld points on the finished metal mesh reinforcement preferably in one piece and uninterruptedly, the winding profile 3 being welded to all of the longitudinal profiles 4 in each case at multiple weld points 75 spaced apart in the longitudinal direction (see FIG. 13) of a longitudinal profile 4.

The machine 1 makes it possible to manufacture e.g. cylindrical reinforcing cages in one piece in a sustained manufacturing process and continuously. In this context, the continuously growing finished portion of the metal mesh reinforcement is advanced along a transporting portion 5 of the machine 1 in a conveying direction F, the continuously growing finished portion being stabilized by means of a retaining arrangement 13 in the process (see, in particular, FIG. 1). The retaining arrangement 13 can be moved along a rail guide 6. After the metal mesh reinforcement is completed, it is removed from the machine 1 by a forklift arrangement 11, which can be moved along a rail guide 12.

The transporting portion 5 is between a front end of the machine 1 and a frame portion 7 of the machine 1. A positioning portion 8 rearwardly adjoins the frame portion 7 opposite to the transporting portion 5. The positioning portion 8 serves to positionally correctly equip the machine 1 with all of the longitudinal profiles 4 of the reinforcing cage to be produced before the start of the production operation for producing the reinforcement. In the process, the pre-positioned longitudinal profiles 4 are spaced apart from one another around the circumference and pushed in parallel to the central longitudinal axis. The longitudinal profiles 4 are also arranged on supports 77 at spoke-like portions 10 of a main wheel 9 (see FIG. 13), which are mounted so as to be rotatable about an axis of rotation D.

The spoke-like portions 10 are on a main wheel 9, which is mounted so as to be rotatable in a direction of rotation B about the axis of rotation D in a motor-driven manner (FIG. 2), the longitudinal profiles 4 (see FIG. 13) resting on supports 77 located at the spoke-like portions 10. The main wheel 9, which is enclosed around the circumference on the outside by the frame portion 7, rotates the longitudinal profiles 4 and the rotatable portions 72 (see FIG. 1) of the positioning portion 8 in the direction of rotation B.

Figure 2:
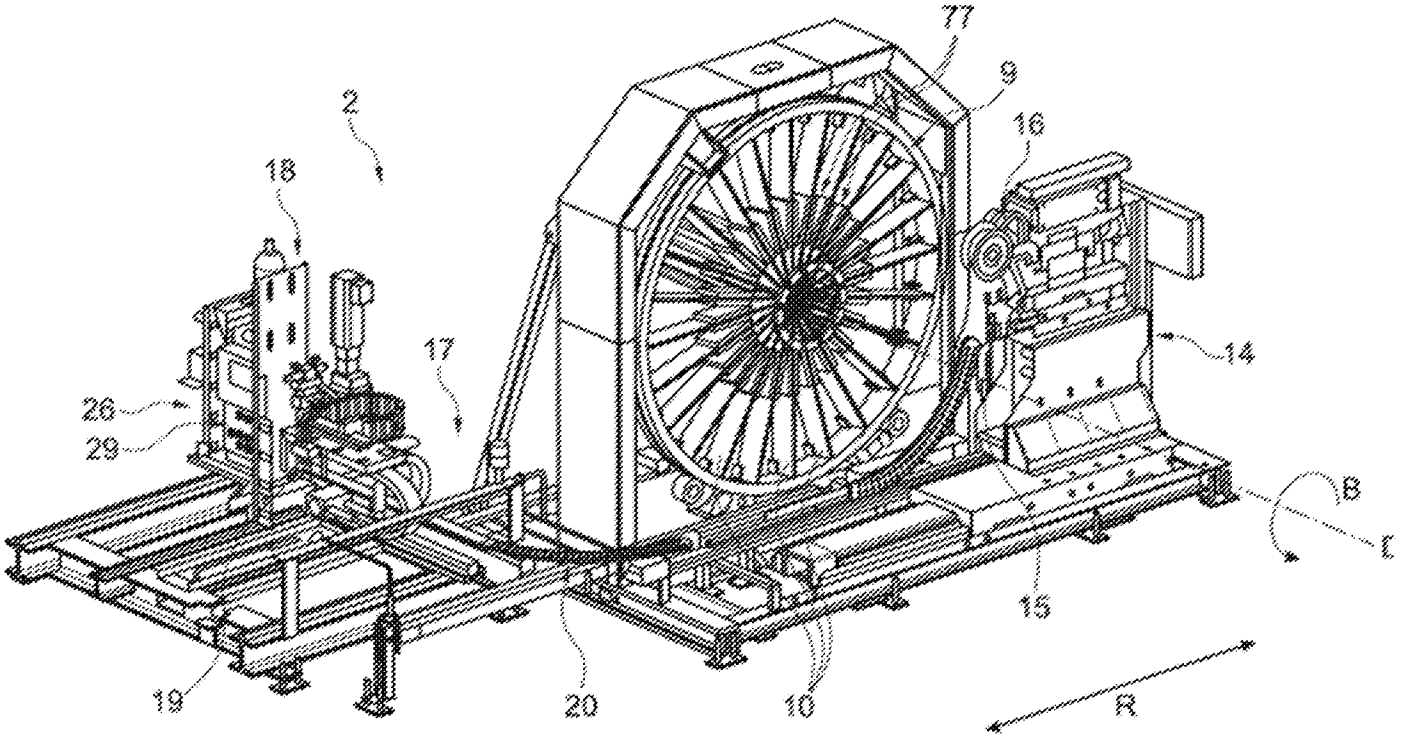
FIG. 2 shows a perspective individual view of part of the device according to FIG. 1.

A part of the device 2, the welding unit 14, which comprises a winding profile guide 15 and a welding arrangement 16 is arranged in the region of the main wheel 9 (FIG. 2). The welding unit 14 can be moved in a perpendicular direction R, in particular, radially, in relation to the axis of rotation D of the main wheel 9, in order to adapt the welding unit 14 to a desired outer dimension of the metal mesh reinforcement. In the respectively set position, the welding unit 14 is in its working position. After the welding unit 14 has been brought into the working position, the position of the welding unit 14 is no longer changed during the welding operation. The outer dimension of the metal mesh reinforcement may vary e.g. up to 1600 mm, and thus the working position of the welding unit also varies e.g. up to 800 mm.

Figure 3:
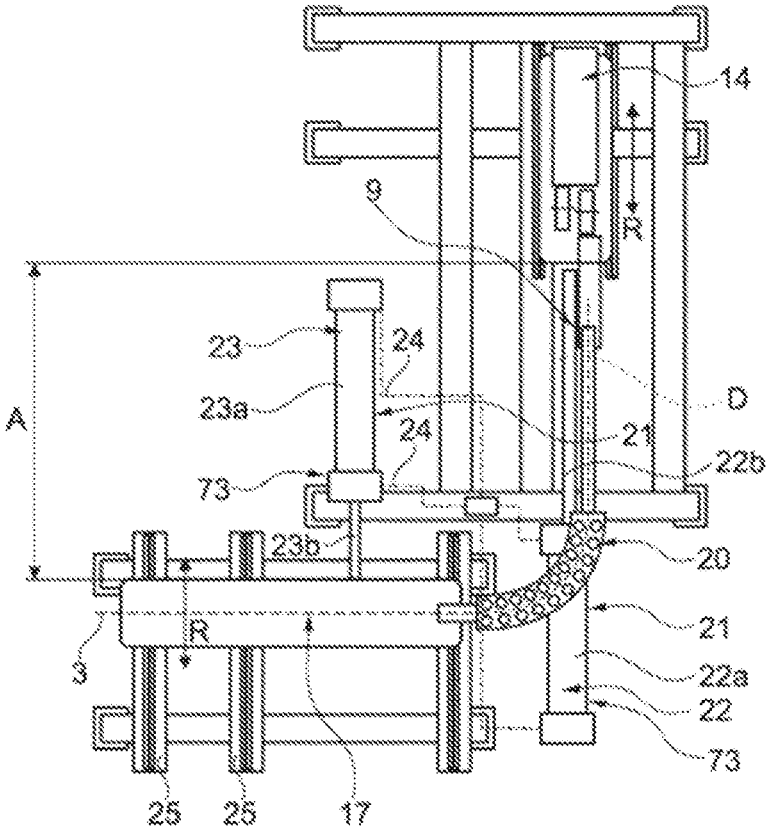
FIG. 3 shows a highly schematic view from above of parts of the device according to FIG. 2.

A feed unit 17 of the device 2 is moved preferably conjointly with the welding unit 14 in a manner coupled thereto, when the welding unit 14 is brought into the respectively desired working position. The feed unit 17 comprises an advancing arrangement 18, a cutting arrangement 19 and deflecting elements 20 (see FIG. 2). The synchronous movement of the feed unit 17 and the welding unit 14 is implemented by a synchronization unit 73, which comprises coupled transmission units 21 (see FIG. 3). The coupled transmission units 21 preferably comprise hydraulic cylinders 22, 23, in particular, at least or preferably precisely two hydraulic cylinders. The coupled transmission units 21 may also be pneumatic and/or electric mechanisms.

If hydraulic cylinders are used, e.g. when the welding unit 14 is moving a piston **22*a* of the first hydraulic cylinder 22 can be moved into a cylinder housing 22*b* of the cylinder 22, with pistons 22*a*, 23*a* being respectively movable relatively in corresponding cylinder housings 22*b*, 23*b*. The movement of the piston 22*a* in the cylinder housing 22*b* displaces e.g. the hydraulic oil out of the first hydraulic cylinder 22. The displaced hydraulic oil passes through hoses 24 into the second hydraulic cylinder 23, with the piston 23*a* of the second hydraulic cylinder 23 being moved out of the cylinder housing 23*b* and thus conjointly moving the feed unit 17**.

The pistons **22*a*, 23*a* of the hydraulic cylinders 22, 23 preferably have the same displacement travel, which extends in a perpendicular direction R in relation to the axis of rotation D of the main wheel 9, and therefore both the welding unit 14 and the feed unit 17 are moved in a perpendicular direction R in relation to the axis of rotation D of the main wheel 9, with the distance A between the feed unit 17 and the welding unit 14 preferably always remaining the same. The feed unit 17 is movable in a perpendicular direction R in relation to the axis of rotation D of the main wheel 9 along guide elements 25**, such as e.g. rails.

The winding profiles 3 are unwound from a master and fed to the device 2, with multiple masters, each having one winding profile 3, being present. In this case, the winding profiles 3 unwound from the masters preferably have different outer dimensions, it generally being the case that only one winding profile 3 is selected for the production of the metal mesh reinforcement, which winding profile will be described by way of example below. It is also conceivable to produce a metal mesh reinforcement with, in particular, different and multiple winding profiles.

Figure 4:
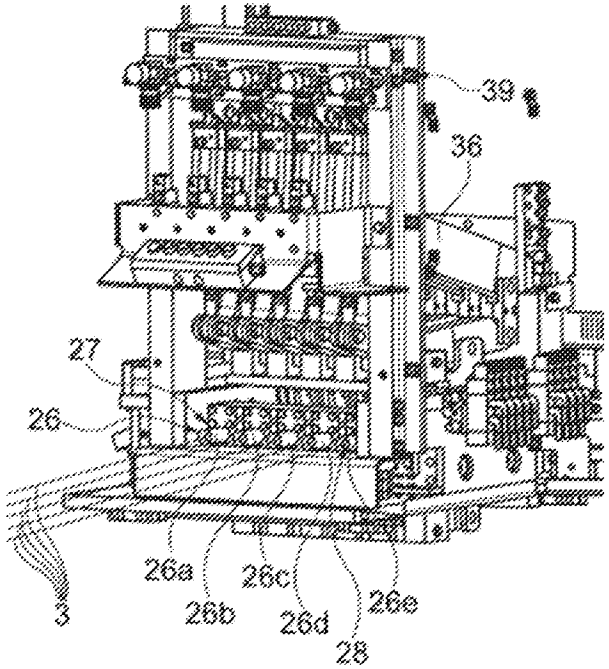
FIG. 4 shows a perspective view of an advancing arrangement of the device according to FIG. 2.

The one selected winding profile 3 is unwound from an associated master, such as e.g. what is referred to as a coil, and a front free end is introduced into a receptacle 26, which preferably has multiple receiving tubes 26*a, b, c, d, e* (see FIG. 4). The receptacle 26 is part of the advancing arrangement 18. In the receptacle 26 there may be multiple winding profiles 3, in particular, five, which are respectively received in an associated receiving tube 26*a, b, c, d, e* for each winding profile 3.

Advantageously, the winding profiles 3, in the present case five, each have different outer dimensions of between 4-10 mm, for example. A profile retaining system 27 and a profile brake 28 are present in each receptacle 26 for each winding profile 3. That is to say, in this instance e.g. five profile retaining systems 27 and five profile brakes 28 (see FIG. 4). The profile retaining systems 27 fixedly retain the winding profiles 3 in the device 2. The profile brakes 28 are configured to reduce the drawing or pushing speed of the selected winding profile 3.

Figure 9:
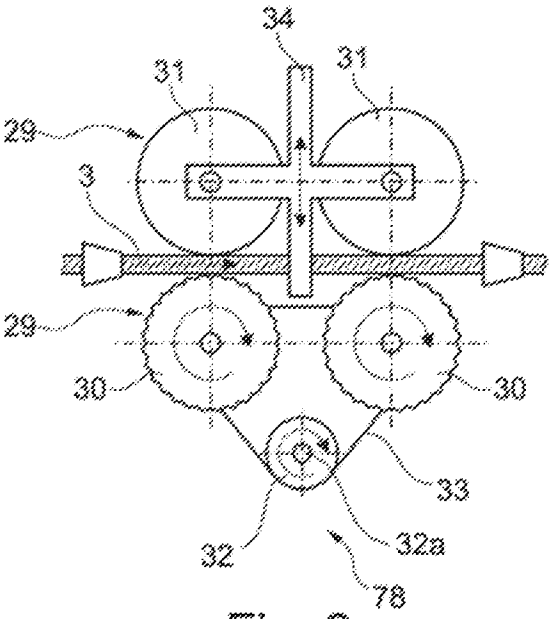
FIG. 9 shows a schematic side view of the detail D from FIG. 8 with an inserted winding profile.
Figure 8:
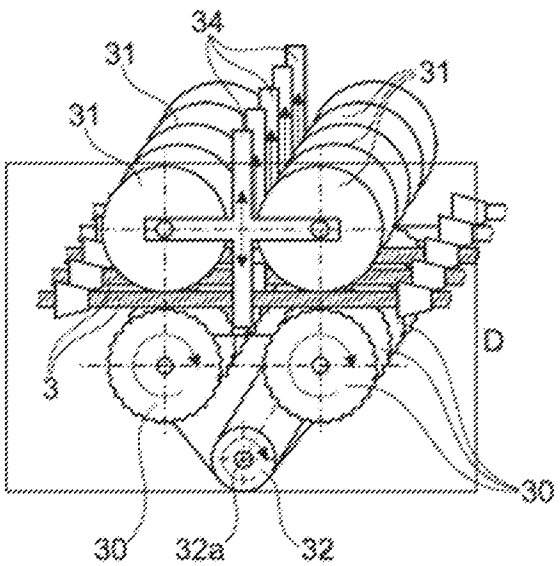
FIG. 8 shows a perspective schematic view of part of the advancing arrangement approximately from detail C of FIG. 6 with multiple schematically illustrated inserted winding profiles.

Following the receptacle 26 in the pushing direction of the winding profile 3 are drive elements 29 which are part of the advancing arrangement 18. For each winding profile 3, respective drive elements 29 are present, which comprise an advancing element 30 and a counter element 31, each of which is in the form of rotatably mounted rollers, for example, e.g. advancing rollers and counter rollers (FIGS. 8-9). For each winding profile 3, e.g. multiple advancing elements 30, preferably two advancing elements 30, are respectively present. For example, two advancing elements 30 are provided and support the winding profile 3 (see, in particular, FIG. 6). All advancing elements 30 are driven e.g. by a common drive unit 78, the drive unit 78 comprising e.g. a drive, e.g. an electric motor, a drive shaft 32*a*, a drive roller 32 and a connecting element 33. In this respect, the advancing elements 30 for one winding profile 3 are each connected to the drive roller 32 by the respective connecting element 33. The connecting element 33 is preferably made from a flexible material, e.g. in the form of a belt or cable. The drive shaft 32*a* transmits the rotational movement of the drive to the drive roller 32. The drive unit 78 makes it possible to rotate the advancing elements 30 both clockwise (FIGS. 8-9) or counterclockwise (not illustrated). If the advancing elements 30 rotate clockwise, the winding profile 3 is pushed to the cutting arrangement 19 by the advancing arrangement 18, whereas when the advancing elements 30 rotate counterclockwise, the winding profile 3 is moved in the direction of the receptacle 26. The advancing elements 30 preferably rotate counterclockwise when the winding profile 3 has been separated in the cutting arrangement 19 and the winding profile 3 is to be changed.

The winding profile 3 can be moved in the advancing region 29 by means of the drive unit 78 only when the counter element 31 presses on the winding profile 3, and therefore the winding profile 3 can be pressed onto the advancing elements 30 (not illustrated). Advantageously, for each winding profile 3 there are multiple counter elements 31, in particular, in each case two counter elements 31 (see FIGS. 6, 8 and 9). The counter elements 31 can be switched from a first switching state into a second switching state, the counter elements 31 not being in contact with the winding profile 3 in the first switching state. In the second switching state, the counter elements 31 press on the selected winding profile 3 (see FIG. 8), which is pressed onto the advancing elements 30. The selected winding profile 3 can then be used for the production of a metal mesh reinforcement.

The counter elements 31 arranged on a winding profile 3 are e.g. connected to one another by means of a connecting element 34. The connecting element 34 is preferably made from metal and/or plastic or the like and, in particular, has a cross-like shape.

Figure 6:
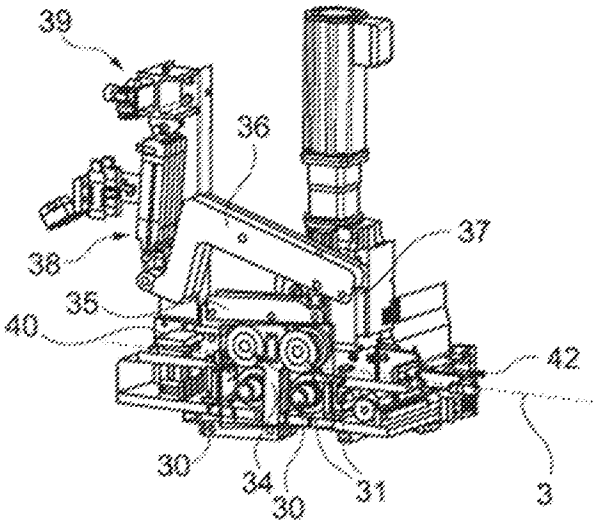
FIG. 6 shows a perspective view of part of the advancing arrangement approximately from detail A in FIG. 5.

Depending on which winding profile 3 is to be used for the production of a metal mesh reinforcement, this selected winding profile 3 is pushed to the welding unit 14, in that the counter elements 31 are vertically moved by means of a pressing element 35 exclusively onto the selected winding profile 3 (see FIG. 6). As a result, the advancing elements 30 are in contact with the winding profile 3. The pressing element 35 can be pressed onto the connecting element 34, in particular, by means of a pivot element 36 (see FIG. 6), which is pivotable about a pivot pin 37. The pivot element 36 is connected to the pivot pin 37 on one side and to a pressing arrangement 38 on the other side. The pressing arrangement 38 is connected to the pivot element 36 at one end and to a fixed frame 39 of the advancing arrangement 18 on the other side. The pressing arrangement 38 preferably comprises a pneumatic and/or a hydraulic unit. The unit comprises a cylinder, for example. In the event of switching from the first switching state to the second switching state, the pressing arrangement 38 presses the one end of the pivot element 36, which is connected to the pressing arrangement 38, toward the counter elements 31, the pivot element 36 being pressed against the pressing element 35 at the pivot pin 37 and therefore pressing the pressing element 35 onto the connecting element 34. A delimiting element 40, which delimits the pivoting movement of the pivot element 36 in the direction of the counter elements 31, is preferably provided for the pivot element 36. The delimiting element 40 preferably has a plate-like form and is produced e.g. from metal.

Figure 5:
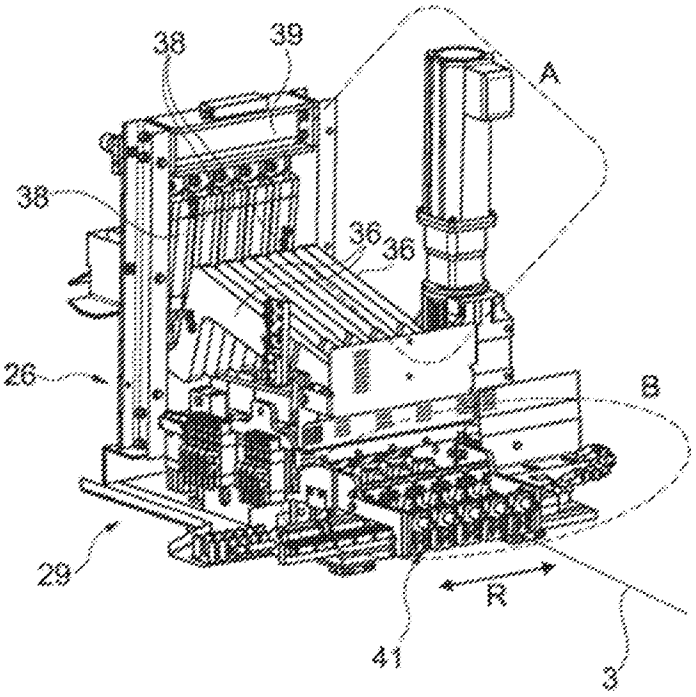
FIG. 5 shows a further perspective illustration of the advancing arrangement from FIG. 4.

On the advancing arrangement 18, following the advancing region in the direction of the cutting arrangement 19 there is a run-out 41, which is formed on the advancing arrangement 17 in the direction of the cutting arrangement 19, for each winding profile 3 (see FIG. 5, detail B). Since only a single winding profile 3 is to be conveyed to the stationary cutting arrangement 19, the run-outs 41 can be moved in a perpendicular direction R in relation to the axis of rotation D. To displace the run-outs 41 in the direction R, a displacement element 42 is formed in the region of the run-outs 41 on the side facing toward the main wheel 9 (see FIG. 7). The displacement element 42 may be an electronic and/or a pneumatic and/or a hydraulic element, e.g. a hydraulic cylinder, preferably a multistage cylinder.

Figure 10:
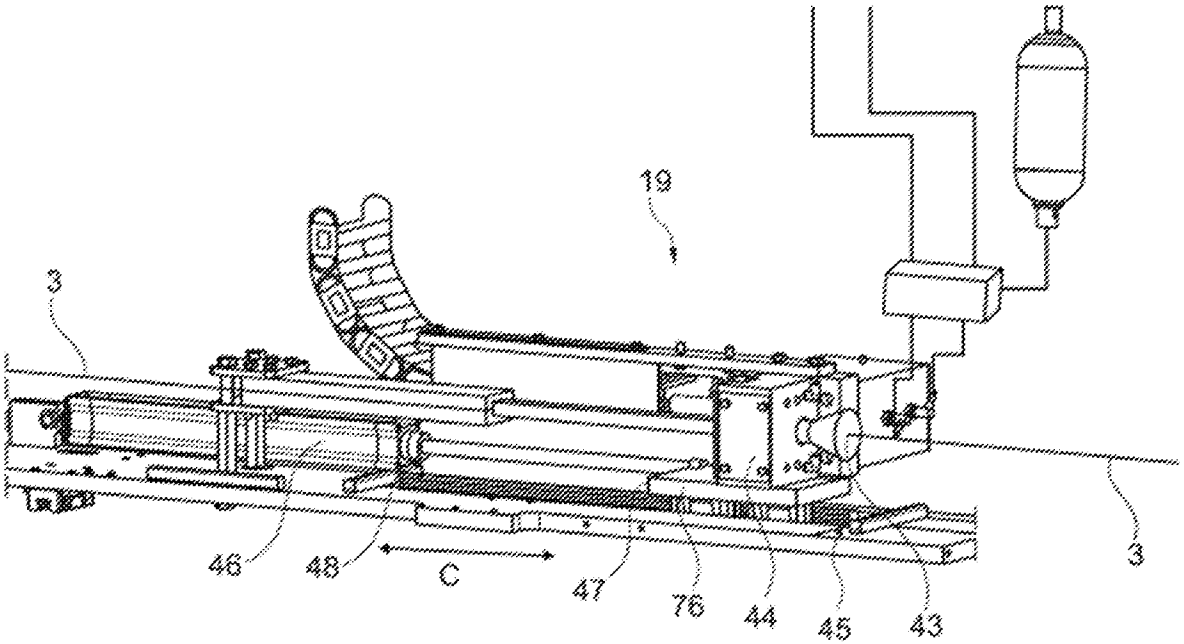
FIG. 10 shows a perspective view of a partially simplified illustration of a cutting arrangement from the device according to FIG. 2.

After the run-out 41, the winding profile 3 passes to the cutting arrangement 19, the winding profile 3 being centerable with respect to an ideal position in the cutting region by means of a pushing-in element 43. The pushing-in element 43 is shaped e.g. in the manner of a funnel and is made, for example, from metal and/or plastic (see FIG. 10). The winding profile 3 is centered in the cutting region by the pushing-in element 43 and can be separated by means of a cutting apparatus 44. The cutting apparatus 44 can be moved in a longitudinal direction of the winding profile 3, and e.g. two cutting members of the cutting apparatus 44 are preferably hydraulically and/or pneumatically pressed together. The cutting apparatus 44 is arranged in a housing, which is movably mounted on a plate 76. The cutting apparatus 44 in the housing can be moved linearly with the plate along a guide 45 and is brought from an end position 48 back to a starting position 47 by a return element 46. The return element 46 is a hydraulic and/or a pneumatic and/or an electric element. The adjustment travel C between the starting position 47 and the end position 48 of the cutting apparatus 44 is advantageously e.g. 350 mm, 300 mm, 250 mm, 200 mm or 150 mm. The longer the adjustment travel is, the further the cutting apparatus 44 can conjointly travel in the advancing direction of the winding profile 3, with the result that the cutting arrangement 19 does not require any reduction or requires only a small reduction in the advancement speed of the winding profile 3 through a cutting operation.

Figure 12:
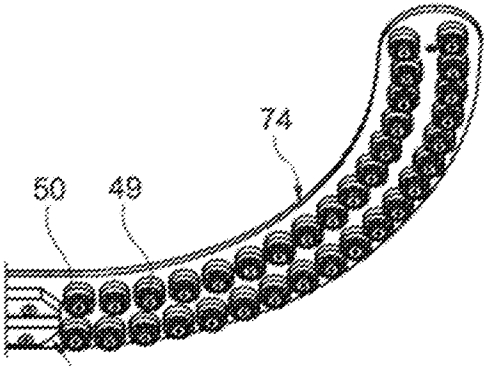
FIG. 12 shows an enlarged view of the detail shown at E in FIG. 11.
Figure 11:
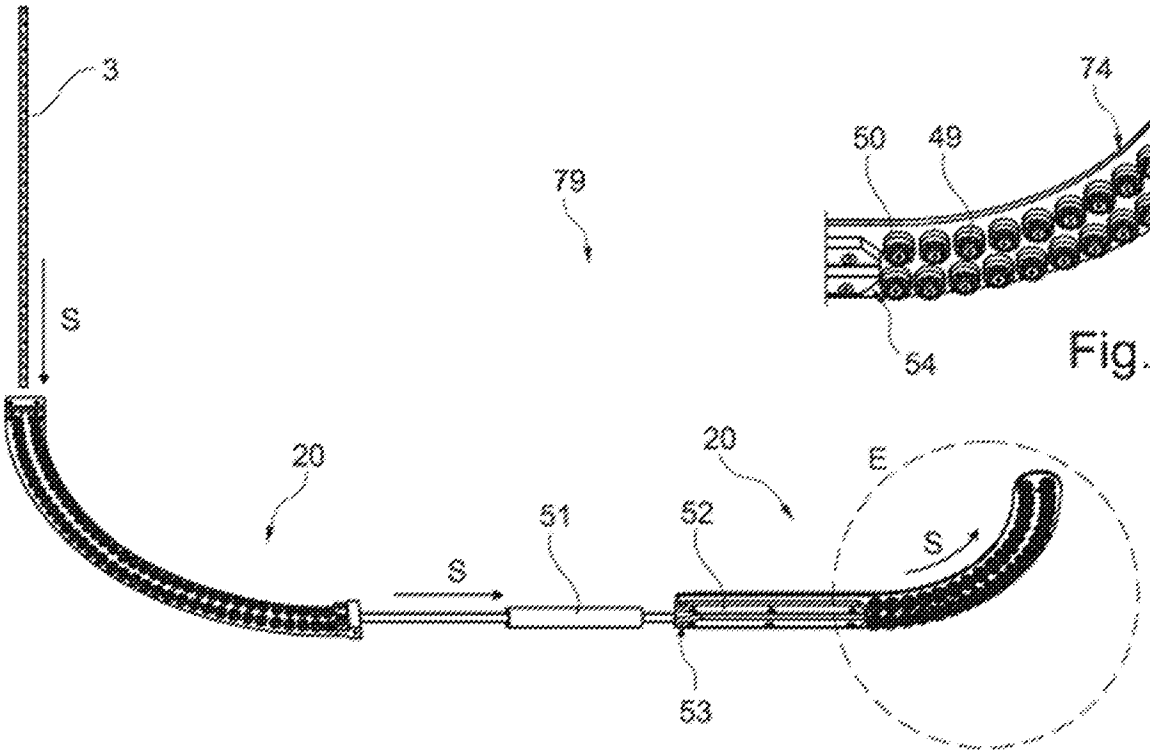
FIG. 11 shows a perspective view of a deflecting element of the device according to FIG. 2 with a schematically illustrated winding profile.

The winding profile 3 can be pushed from the cutting arrangement 19 to the welding unit 14 through the guide mechanism 79, which comprises curved deflecting elements 20 and a straight channel 51 (see FIG. 11). The deflecting elements 20 comprise base plates 74, rollers 49 arranged on the base plates 74, and slide strips 52. Here, the guide mechanism 79 forms a push channel for the winding profile 3, which is moved in a pushing direction S, a pushing direction S of the winding profile 3 being changed by the deflecting elements. The deflecting elements 20 are illustrated in FIGS. 11-12 without a cover, which is preferably present. Since the winding profile 3 has different rigidities depending on the outer dimension and the material, the deflecting elements 20 are formed in curves in order to reliably change the direction of the winding profile 3. The deflecting elements 20 are preferably aligned in a floor plane or a plane at an angle thereto. In order that the winding profile 3 can be pushed through the deflecting elements 20, the sides of the deflecting elements 20 comprise rollers 49 (see FIG. 12). The rollers 49 are preferably respectively formed in pairs or as twin rollers on a common central axis, with the result that between the rollers 49 there is preferably a circumferential annular groove 50, in which the winding profile 3 dips, in particular, partially from the outside. The rollers 49 are closely next to one another and, on the opposite side to each e.g. twin roller 49, there is one or two twin rollers 49. The rollers 49 are rotatably mounted on a pin on the base plate 74 of the deflecting elements 20. To conduct the winding profile 3 from the cutting arrangement 19 to the welding unit 14, two deflecting elements 20 are preferably present, between which the winding profile 3 is guided through a channel 51.

In addition to rollers 49, it is also possible for the slide strips 52 to be arranged on the deflecting elements 20, between which slide strips the winding profile 3 is conducted through. The channel formed by the slide strips 52 preferably has an opening side 53 and an exit side 54. The opening side 53 has e.g. a funnel-shaped section, by way of which the winding profile 3 can be positioned between the slide strips 52 more easily. Adjoining the exit side 54 there are preferably rollers 49 with a spacing in between, into which a winding profile 3 can be threaded.

The winding profile 3 can be pushed to the winding profile guide 15 from the deflecting elements 20. The winding profile guide 15 has a run-in side 58, where the winding profile 3 is pushed into the winding profile guide 15, and a run-out side 59, at which the winding profile 3 is pushed to the welding arrangement 16 (FIG. 13). The winding profile guide 15 has two sides: a contact side 55 and a positioning side 56. The winding profile 3 rests on the contact side 55 in the region of the run-out side 59. The positioning side 56 has an elongate depression 60 which is adapted to the winding profile 3 (FIG. 14) and is designed such that winding profiles 3 with different outer dimensions can be centered on a weld point 75. For this purpose, the positioning side 56 is moved toward the contact side 55, the winding profile 3 lying between the two sides. The positioning side 56 is pivoted toward the winding profile 3 and/or the contact side 55 about a pivot pin 57. When the winding profile 3 is located between the contact side 55 and the positioning side 56, the winding profile 3 is positioned on the weld point 75 by way of the depression 60 on the positioning side 56. The depression 60 is preferably in the form of a prism and formed e.g. along the entire positioning side 56 from the run-in side 58 to the run-out side 59. The depression 60 makes it possible to center any winding profile 3 with a respectively different outer dimension, in particular, between 4-10 mm, on the weld point 75. For this purpose, the positioning side 56 is moved or pivoted toward the contact side 55.

The contact side 55 is preferably also movable tangentially in relation to the main wheel 9, with the result that the distance between the run-out side 58 and the weld point 75 is almost eliminated, preferably e.g. is in a range of a few millimeters.

The winding profile 3 is positioned on the weld point 75 by the positioning side 56, in particular, provided that no welding operation has taken place. After a winding profile 3 has been welded to one or more longitudinal profiles 4, the positioning side 56 is advantageously moved away or pivoted away from the contact side 55.

Furthermore, after a pair of weld points 75 the winding profile 3 no longer needs to be pushed to the welding arrangement by the advancing elements 30 and counter elements 31, but rather the winding profile 3 is drawn by the rotational movement of the main wheel 9, on which the longitudinal profiles 4 are arranged, about the axis of rotation D and thus unwound from the master.

In order to stop the pushing movement, the counter elements 31, which rest on the selected winding profile 3, switch from the second switching state to the first switching state and are thus no longer pressed on the winding profile 3 and, therefore, the winding profile 3 is no longer driven by the advancing arrangement 18.

Figure 15:
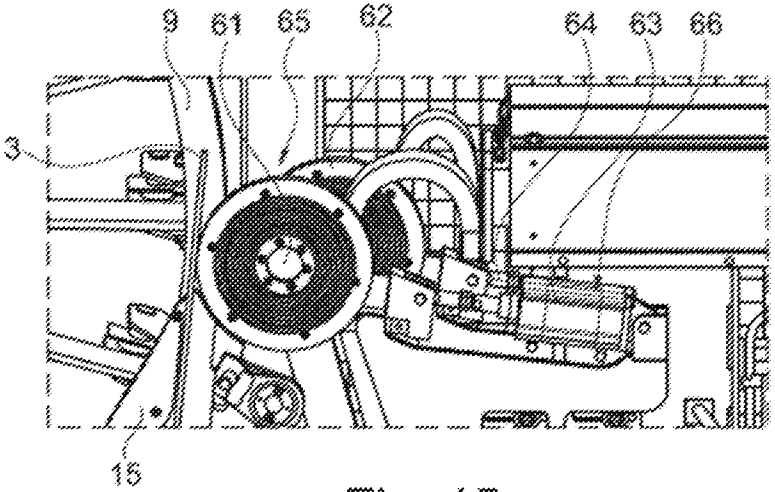
FIG. 15 shows a perspective view of a detail of the welding arrangement of the device according to FIG. 2.

After the winding profile 3 has been positioned by the two sides 55, 56 of the winding profile guide 15, the winding profile 3 positionally correctly rests on the weld point 75 for being welded to the longitudinal profile 4. The welding arrangement 16 welds the two profiles to one another at a weld point 75. The welding arrangement 16 comprises two electrodes: a welding electrode 61 and a contact electrode 62 (see FIG. 15). The welding electrode 61 and the contact electrode 62 are preferably in the form of rotatably mounted rollers. The two electrodes 61, 62 are preferably made from metal, in particular, from copper.

The welding electrode 61 is arranged directly at or in a close range of at most a few centimeters from the run-out side 59 of the winding profile guide 15. To weld a longitudinal profile 4 to a winding profile 3, the winding profile 3 is pressed on the longitudinal profile 4 using the welding electrode 61.

In order to enable a predefinable pressing force of the welding electrode 61 during working operation and to minimize influences caused by wear of the electrode material, the welding electrode 61 is mounted yieldably and resiliently. The resilient mounting damps the movement of the welding electrode 61. For the preferably resilient mounting and positioning of the welding electrode 61, e.g. a cylinder/piston unit 63 with a cylinder and a piston that can be moved relative to the cylinder is provided. The cylinder/piston unit 63 is preferably a pneumatic cylinder/piston unit. The welding electrode 61 is coupled to the piston that can be displaced in the cylinder e.g. via a piston rod 64.

The contact electrode 62 is preferably also correspondingly pneumatic-spring mounted and positionable via a cylinder/piston unit 63, preferably a pneumatic cylinder/piston unit. The contact electrode 62 presses with the pressing force on a contact body 65, which is formed on the main wheel 9 at the spoke-like portions 10, and in the respect the contact bodies 65 are spaced apart from the longitudinal profiles 4 at the spoke-like portions 10.

With each new metal mesh reinforcement to be produced, the complete welding unit 14 together with the contact electrode 62 and the welding electrode 61 is moved in an automated manner until the contact electrode 62 rests on a contact body 65 on the main wheel by way of a lift. The contact body 65 preferably consists of metal, in particular, copper. Lift refers to a standard retracted state of the piston rod 64 in question. This means that the welding unit 14 is moved not just until contact is made with the contact electrode 62, but further by a value "X". This value "X" corresponds to the lift and is detected and signaled via a travel sensor 66 on or in the cylinder, preferably in the pneumatic cylinder. The travel sensor 66 detects the retraction stroke and provides a corresponding signal to the control unit.

After this, a bracket, which is connected to the welding electrode 61 and movably mounted on the welding unit 14, is likewise moved forward until the standard lift of the welding electrode 61 is also reached, this likewise being done by means of a travel sensor 66 in a manner corresponding to the lift of the contact electrode 62 described above.

The lift is preferably predefined and set by means of the control unit in an automated manner.

This procedure according to the present invention is advantageous with respect to a procedure which proceeds in reverse and in which the welding unit 14 is moved until a target state of the welding electrode 61 is reached, and the contact electrode 62 is manually set after this.

Figure 16:
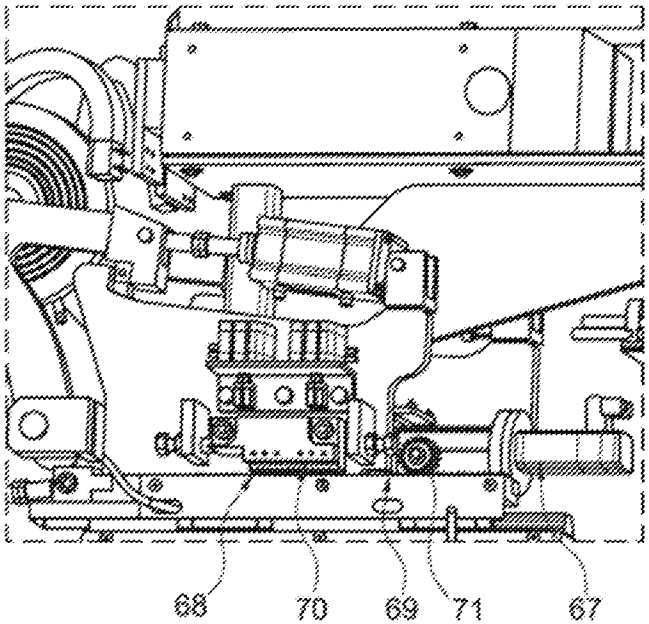
FIG. 16 shows a further perspective detail of the welding arrangement according to FIG. 2.

The welding unit 14 may be displaced back and forth reversibly in a perpendicular direction R, in particular radially, in relation to the axis of rotation D of the main wheel 9 along a linear guide 68 by means of a drive 67 (see FIG. 16). The drive 67 is preferably an electric drive, such as a spindle drive, for example. The set working position is preferably locked, e.g. mechanically. A distinction should be made between the locking and a preferably present fine positioning of the welding electrode 61 and/or the contact electrode 62. The fine positioning is preferably always present and independent of the locked working position of the welding unit 14 and is achieved by the toothed rod 69 with a toothed contour and a mating toothed contour 70.

The locking is preferably done by a clamping mechanism. For example, a clamping mechanism is set up with the clamping mechanism having a toothing with a toothed rod 69, which comprises a toothed contour, and a mating toothed contour 70, which fits into the toothed contour of the toothed rod 69 (FIG. 16). The linearly movable toothed rod 69 is linearly moved e.g. via the drive 67, such as the electric spindle drive, by means of a toothed wheel 71, that can be rotated by the drive 67, in order to set the working position of the welding unit 14.

LIST OF REFERENCE SIGNS

1 Machine
2 Device
3 Winding profile
4 Longitudinal profile
5 Transporting portion
6 Rail guide
7 Frame portion
8 Positioning portion
9 Main wheel
10 Portion
11 Forklift arrangement
12 Raid guide
13 Retaining arrangement
14 Welding unit
15 Winding profile guide
16 Welding arrangement
17 Feed unit
18 Advancing arrangement
19 Cutting arrangement
20 Deflecting element
21 Transmission unit
22 First hydraulic cylinder
**22*a*** Piston
**22*b*** Cylinder housing
23 Second hydraulic cylinder
**23*a*** Piston
**23*b*** Cylinder housing
24 Hose
25 Guide elements
26 Receptacle
**26*a*** Receiving tube
**26*b*** Receiving tube
**26*c*** Receiving tube
**26*d*** Receiving tube
**26*e*** Receiving tube
27 Profile retaining system
28 Profile brake
29 Drive elements
30 Advancing element
31 Counter element
32 Drive roller
**32*a*** Drive shaft
33 Connecting element
34 Connecting element
35 Pressing element
36 Pivot element
37 Pivot pin
38 Pressing arrangement
39 Frame
40 Delimiting element
41 Run-out
42 Displacement element
43 Push-in element
44 Cutting apparatus
45 Guide
46 Return element
47 Starting position
48 End position
49 Rollers
50 Indentation
51 Channel
52 Slide strip
53 Opening side
54 Exit side
55 Contact side
56 Positioning side
57 Pivot pin
58 Run-in side
59 Run-out side

60 Depression
61 Welding electrode
62 Contact electrode
63 Cylinder/piston unit
64 Piston rod
65 Contact body
66 Travel sensor
67 Drive
68 Linear guide
69 Toothed rod
70 Toothed contour
71 Toothed wheel
72 Portions
73 Synchronization unit
74 Base plate
75 Weld point
76 Plate
77 Support
78 Drive unit
79 Guide mechanism

The invention claimed is:

1. A machine for producing a metal mesh reinforcement from interconnected metal profiles, wherein the metal mesh reinforcement has multiple longitudinal profiles and one winding profile, wherein the machine has a device and a driven, rotatable main wheel for receiving multiple longitudinal profiles, wherein the device comprises a welding unit for welding a longitudinal profile to the winding profile at a connecting point of two interconnected metal profiles and a feed unit for feeding a portion of the winding profile, provided from a master coil, to the welding unit, wherein the feed unit comprises a cutting arrangement for severing the winding profile in order to separate a profile portion of the winding profile from the master coil, wherein the cutting arrangement is located in a cutting region of the device that is remote from the welding unit, wherein the device is configured, after the winding profile has been severed, to feed an end portion of the winding profile that was separated from the master coil from the cutting region to the welding unit and at least one further weld is made between a separated end portion of the winding profile and a longitudinal profile to complete the metal mesh reinforcement, wherein the feed unit comprises an advancing arrangement with a drive unit for a driven movement of the winding profile in a longitudinal direction of the winding profile, wherein the advancing arrangement is designed to move, from among multiple winding profiles provided next to one another in the feed unit, one of the multiple provided winding profiles to the welding unit in a driven manner by means of the drive unit, wherein the advancing arrangement is designed to move, from among multiple winding profiles provided next to one another in the feed unit, precisely one of the multiple provided winding profiles to the welding unit in a driven manner by means of the drive unit.

2. The machine as claimed in claim 1, further comprising a synchronization unit, which is designed in such a way that the feed unit and the welding unit can be moved at the same time and together in a common direction coupled to one another, when the welding unit can be adapted in a driven manner to the feed unit drive unit to a desired outer dimension of the metal mesh reinforcement, in order to predefine a working position of the welding unit in which the welding unit remains for the production of a metal mesh reinforcement with a constant outer dimension.

3. The machine as claimed in claim 1, wherein the winding profile has at least two winding profile portions, wherein the first winding profile portion has a constant first outer dimension and the second winding profile portion has a constant second outer dimension different to the first outer dimension, wherein the device is designed in such a way that the winding profile portions with different outer dimensions can be interchanged in an automated manner during the production of the metal mesh reinforcement.

4. The machine as claimed in claim 1, wherein the welding unit is present in such a way that the welding unit can be adjusted in a direction transverse to the longitudinal extent of the longitudinal profile to adapt to the working position.

5. The machine as claimed in claim 2, wherein the synchronization unit has transmission units, by way of which the feed unit and the welding unit are coupled to one another in such a way that the feed unit and the welding unit can be moved at the same time.

6. The machine as claimed in claim 1, wherein the device comprises a receptacle, in which multiple separate and different winding profiles can be supplied in such a way that selectively precisely one of the multiple winding profiles supplied in the receptacle can be fed to the cutting arrangement.

7. The machine as claimed in claim 1, wherein the provided winding profiles are interchangeable in an automated manner in the advancing arrangement.

8. The machine as claimed in claim 1, wherein the advancing arrangement has two oppositely situated drive elements comprising an advancing element and a counter element, wherein the drive elements make it possible to apply a driving action to precisely the one of the multiple provided winding profiles.

9. The machine as claimed in claim 1, wherein the drive unit has an advancing element or multiple advancing elements that is or are driven at the same time in a driving state by the drive unit.

10. The machine as claimed in claim 8, wherein the counter element can be transferred from a first switching state into a second switching state by a switching device, wherein the counter element presses the selected winding profile onto the advancing element in the second switching state.

11. The machine as claimed in claim 1, wherein the advancing arrangement comprises a profile retaining system and/or a profile brake, which are present for a winding profile, wherein the profile retaining system is designed to retain those winding profiles that from among all of the supplied winding profiles are not selected for processing, wherein just one single winding profile can be selected for the further processing.

12. The machine as claimed in claim 1, wherein the cutting arrangement is designed such that the winding profile can be severed while the winding profile is moved at the same time in its longitudinal direction to the welding unit.

13. The machine as claimed in claim 1, wherein the feed unit comprises a guide mechanism, which is designed to guide the driven winding profile from the cutting arrangement to the welding unit, wherein the guide acts contiguously on the winding profile at least in certain portions, so as to define the spatial travel of the winding profile moving in a driven manner.

14. The machine as claimed in claim 1, wherein the welding unit comprises a winding profile guide and a welding arrangement, wherein the winding profile guide is designed to conduct the winding profile to the welding arrangement.

15. The machine as claimed in claim 14, wherein the winding profile guide has a contact side and a positioning side, wherein the contact side and the positioning side can be moved relative to one another, and wherein the contact side and the positioning side are matched to one another in such a way that a winding profile guided up between the contact side and the positioning side is forced into a centered position when the positioning side and the contact side are moved toward one another.

16. The machine as claimed in claim 15, wherein the positioning side has a depression matched to the winding profile.

17. The machine as claimed in claim 14, wherein the welding arrangement can be moved in a direction transverse to the longitudinal extent of the longitudinal profile.

18. The machine as claimed in claim 1, further comprising a spring mounting designed to compensate for a difference in the outer dimension of the winding profile and/or a wear of the welding arrangement in an automated manner.

19. The machine as claimed in claim 1, further comprising a welding electrode positioned in a predefinable and fixed working position by a drive, wherein a locking mechanism is present which positionally fixedly holds the welding electrode in the working position.

20. A machine for producing a metal mesh reinforcement from interconnected metal profiles, wherein the metal mesh reinforcement has multiple longitudinal profiles and one winding profile, wherein the machine has a device and a driven, rotatable main wheel for receiving multiple longitudinal profiles, wherein the device comprises a welding unit for welding a longitudinal profile to the winding profile at a connecting point of two interconnected metal profiles and a feed unit for feeding a portion of the winding profile, provided from a master coil, to the welding unit, wherein the feed unit comprises a cutting arrangement for severing the winding profile in order to separate a profile portion of the winding profile from the master coil, wherein the cutting arrangement is located in a cutting region of the device that is remote from the welding unit, wherein the device is configured, after the winding profile has been severed, to feed an end portion of the winding profile that was separated from the master coil from the cutting region to the welding unit and at least one further weld is made between a separated end portion of the winding profile and a longitudinal profile to complete the metal mesh reinforcement, wherein the feed unit comprises an advancing arrangement with a drive unit for a driven movement of the winding profile in a longitudinal direction of the winding profile, wherein the advancing arrangement is designed to move, from among multiple winding profiles provided next to one another in the feed unit, one of the multiple provided winding profiles to the welding unit in a driven manner by means of the drive unit, wherein the welding unit comprises a winding profile guide and a welding arrangement, wherein the winding profile guide is designed to conduct the winding profile to the welding arrangement, and wherein the winding profile guide has a contact side and a positioning side, wherein the contact side and the positioning side can be moved relative to one another, and wherein the contact side and the positioning side are matched to one another in such a way that a winding profile guided up between the contact side and the positioning side is forced into a centered position when the positioning side and the contact side are moved toward one another.

* * * * *